US010525735B2

(12) United States Patent
Fernando et al.

(10) Patent No.: US 10,525,735 B2
(45) Date of Patent: Jan. 7, 2020

(54) CURL RESISTANT WEB HANDLING SYSTEM

(71) Applicants: Dilan N. Fernando, Thornton, CO (US); Stuart J. Boland, Denver, CO (US); Robert F. Jessen, Berthoud, CO (US)

(72) Inventors: Dilan N. Fernando, Thornton, CO (US); Stuart J. Boland, Denver, CO (US); Robert F. Jessen, Berthoud, CO (US)

(73) Assignee: Ricoh Company, Ltd., Tokyo (JP)

( * ) Notice: Subject to any disclaimer, the term of this patent is extended or adjusted under 35 U.S.C. 154(b) by 631 days.

(21) Appl. No.: 14/872,368

(22) Filed: Oct. 1, 2015

(65) Prior Publication Data

US 2017/0096017 A1 Apr. 6, 2017

(51) Int. Cl.

| | |
|---|---|
| ***B41J 11/00*** | (2006.01) |
| ***B41J 15/00*** | (2006.01) |
| ***B65H 20/34*** | (2006.01) |
| ***G03G 15/00*** | (2006.01) |
| ***B65H 23/188*** | (2006.01) |
| ***B65H 23/34*** | (2006.01) |
| ***F26B 3/28*** | (2006.01) |
| ***F26B 13/08*** | (2006.01) |
| ***F26B 13/12*** | (2006.01) |
| ***F26B 13/14*** | (2006.01) |

(52) U.S. Cl.

CPC ..... *B41J 11/0015* (2013.01); *B41J 11/002* (2013.01); *B41J 11/0005* (2013.01); *B41J 15/005* (2013.01); *B65H 20/34* (2013.01); *B65H 23/1888* (2013.01); *B65H 23/34* (2013.01); *F26B 3/28* (2013.01); *F26B 13/08* (2013.01); *F26B 13/12* (2013.01); *F26B 13/14* (2013.01); *G03G 15/6517* (2013.01); *B65H 2301/517* (2013.01); *B65H 2301/5143* (2013.01); *B65H 2301/51256* (2013.01); *B65H 2403/942* (2013.01); *B65H 2408/2171* (2013.01); *B65H 2801/06* (2013.01); *B65H 2801/15* (2013.01)

(58) Field of Classification Search

None

See application file for complete search history.

(56) References Cited

U.S. PATENT DOCUMENTS

| | | | | |
|---|---|---|---|---|
| 5,416,980 | A | 5/1995 | Ilvespaa | |
| 6,340,215 | B1 * | 1/2002 | Yamakita | B41J 11/002 347/4 |

(Continued)

FOREIGN PATENT DOCUMENTS

| | | | |
|---|---|---|---|
| EP | 1391298 | A1 | 2/2004 |
| GB | 2464758 | A | 5/2010 |

(Continued)

OTHER PUBLICATIONS

EP Search Report, 16190723.3, 9 pages, dated Mar. 29, 2017.

*Primary Examiner* — Alejandro Valencia

(74) *Attorney, Agent, or Firm* — Jaffery Watson Mendonsa & Hamilton LLP

(57) ABSTRACT

A web handling system is disclosed. The web handling system includes first dancer rollers coupled to engage and move a web of a print medium in a forward and backward direction upon stopping a printing operation and allow forward motion during the printing operation.

7 Claims, 6 Drawing Sheets

(56) References Cited

U.S. PATENT DOCUMENTS

| | | | | |
|---|---|---|---|---|
| 6,543,201 | B2 * | 4/2003 | Cronauer | B65B 41/16 53/131.2 |
| 7,337,936 | B2 | 3/2008 | Ishida et al. | |
| 8,249,480 | B2 | 8/2012 | Aslam et al. | |
| 8,434,849 | B2 | 5/2013 | Kurasawa et al. | |
| 8,840,213 | B2 * | 9/2014 | Imamura | B41J 11/0085 347/104 |
| 9,039,122 | B2 | 5/2015 | Walker et al. | |
| 2007/0289460 | A1 | 12/2007 | Tang | |
| 2011/0316909 | A1 * | 12/2011 | Yamanobe | B41J 11/0015 347/8 |
| 2014/0071195 | A1 | 3/2014 | Richmond et al. | |

FOREIGN PATENT DOCUMENTS

| | | | |
|---|---|---|---|
| JP | 03007366 | A | 1/1991 |
| JP | 07247045 | A | 9/1995 |
| JP | 2011207054 | A | 10/2011 |
| JP | 1888162014 | A | 10/2014 |
| JP | 2014188816 | | 10/2014 |
| JP | 2014219114 | A | 11/2014 |
| WO | 2015078851 | A1 | 6/2015 |

* cited by examiner

CURL RESISTANT WEB HANDLING SYSTEM

FIELD OF THE INVENTION

The invention relates to the field of production printing systems, and in particular, to curl resistant handling of print media.

BACKGROUND

Entities with substantial printing demands typically implement a high-speed production printer for volume printing (e.g., one hundred pages per minute or more). Production printers include continuous-forms printers that print ink or toner on a web of print media stored on a large roll. An ink jet production printer typically includes a localized print controller that controls the overall operation of the printing system, and a print engine that includes one or more printhead assemblies, where each assembly includes a printhead controller and a printhead (or array of printheads). An individual ink jet printhead typically includes multiple tiny nozzles that discharge ink as controlled by the printhead controller. A printhead array is formed from multiple printheads that are spaced in series across the width of the web of print media.

While the ink jet printer prints, the web is quickly passed underneath the nozzles, which discharge ink onto the web at intervals to form pixels. A dryer, installed downstream from the printer, may assist in drying the wet ink on the web after the web leaves the printer. In an electrophotographic production printer, the imaged toner is fixed to the web with a high temperature fuser. Handling the web can prove challenging due to variation of a number of factors.

One such factor occurs when the printer stops printing, at which time curling and browning of the web around small diameter, high temperature rollers may occur. Rollers attain high temperature either directly from heaters or indirectly such as from contact with a heated web. A web engaged in a dancer roller mechanism is susceptible to this issue. Dancer rollers mechanisms may be used at various points in a web handling system in order to buffer the web or maintain web tension despite the different web handling characteristics (e.g., speed variations, acceleration and deceleration profiles) of the different pieces of web handling equipment that compose a web handling system. Dancer roller mechanisms can also be used to cool the web, such as by exposing the web to cooling airflow or through chilled rollers. Existing external dryers may include a dancer roller mechanism on the exit end of the dryer to buffer the web, maintain tension and cool the web during printing. However, the dancer roller mechanism does not address the curling or browning issue when printing stops.

Accordingly, a curl resistant web handler is desired.

SUMMARY

In one embodiment, a web handling system is disclosed. The web handling system includes first dancer rollers coupled to engage and move a web of a print medium in a forward and backward direction upon stopping a printing operation and allow forward motion during the printing operation.

In another embodiment, the dryer includes a stationary roller to cure ink on a printed side of a web of a print medium, drying rollers to engage the web to convey the web during a printing operation and to disengage from the web upon stopping of the printing operation and output dancer rollers to disengage the web during the printing operation and to engage the web upon stopping of the printing operation.

BRIEF DESCRIPTION OF THE DRAWINGS

A better understanding of the present invention can be obtained from the following detailed description in conjunction with the following drawings, in which.

DETAILED DESCRIPTION

A curl resistant web handling system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
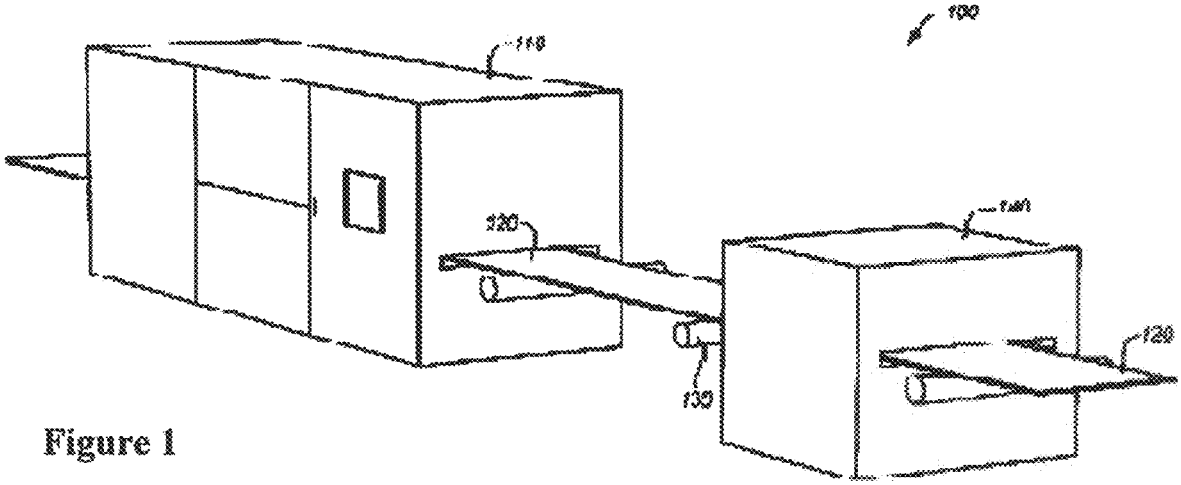
FIG. 1 illustrates one embodiment of a printing system.

FIG. 1 illustrates one embodiment of a printing system 100. Printing system 100 includes production printer 110, which is configured to apply ink onto a web 120 of continuous-form print media (e.g., paper). As used herein, the word "ink" is used to refer to any suitable marking material (e.g., aqueous inks, oil-based paints, toners, etc.). Printer 110 may include an inkjet printer that applies colored inks, such as Cyan (C), Magenta (M), Yellow (Y), Key (K) black, white, or clear inks. The ink applied by printer 110 to the web 120 is wet. Thus, the ink may smear if it is not dried before further processing. One or more rollers 130 position web 120 as it travels through printing system 100.

To dry ink, printing system 100 also includes drying system 140 (e.g., a radiant dryer). In one embodiment, drying system 140 is an independent device downstream from printer 110. However, embodiments may feature drying system being incorporated within printer 110. Web 120 travels through drying system 140 to dry the ink onto web 120.

Figure 2:
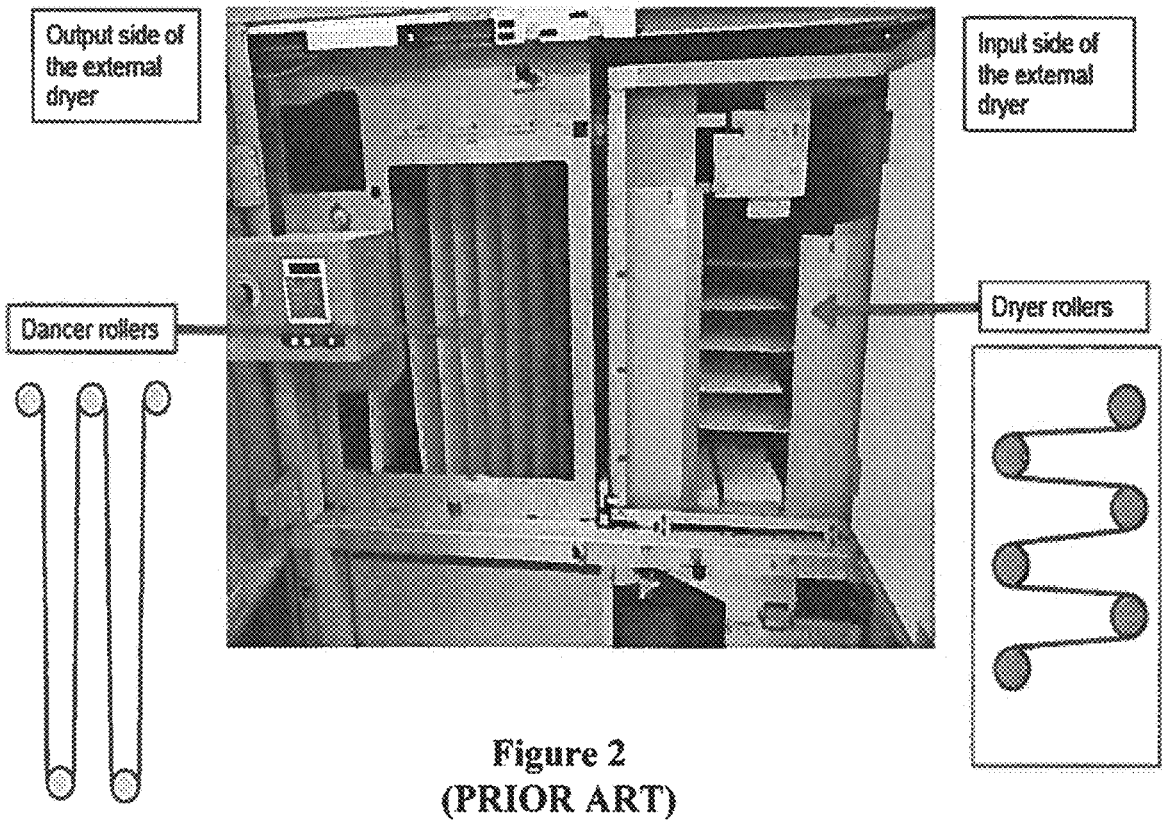
Figure 2 (PRIOR ART)
FIG. 2 illustrates a conventional drying system.

Although discussed as a drying system, embodiments may feature implementation of system 140 as an independent web-handling device downstream from printer 110, as will be discussed in more detail below. Further embodiments may feature a web-handling system 140 being incorporated within printer 110. In such embodiments, web 120 travels through web handling system 140 to be buffered, tensioned or cooled. FIG. 2 illustrates an exemplary drying (or web handling) system. As shown in FIG. 2, the drying system includes a set of drying rollers at the input side and a set of dancing rollers at the output side. As discussed above, curling and browning of the web around the drying rollers may occur when printing stops.

Figure 3A:
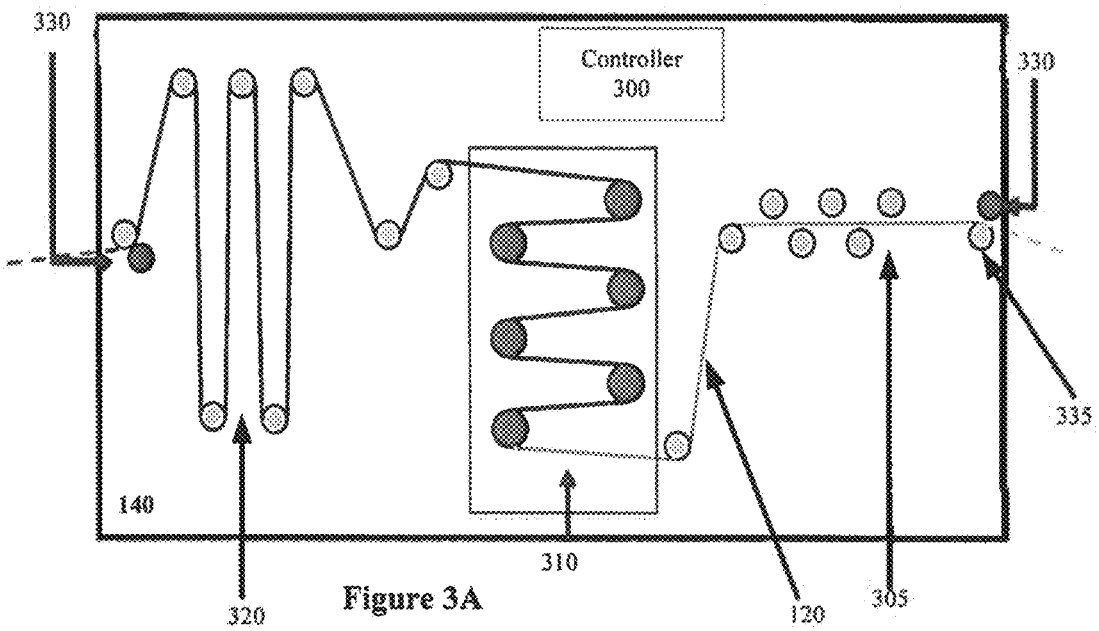
FIGS. 3A-3C illustrate embodiments of a curl resistant dryer.
Figure 3B:
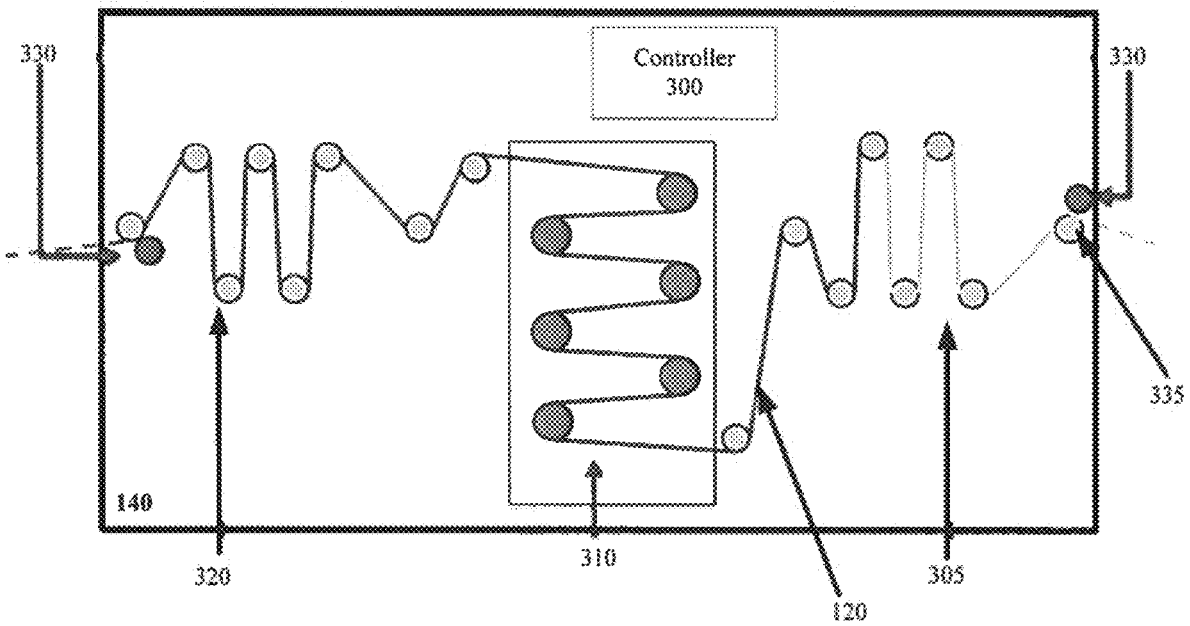
Figure 3C:
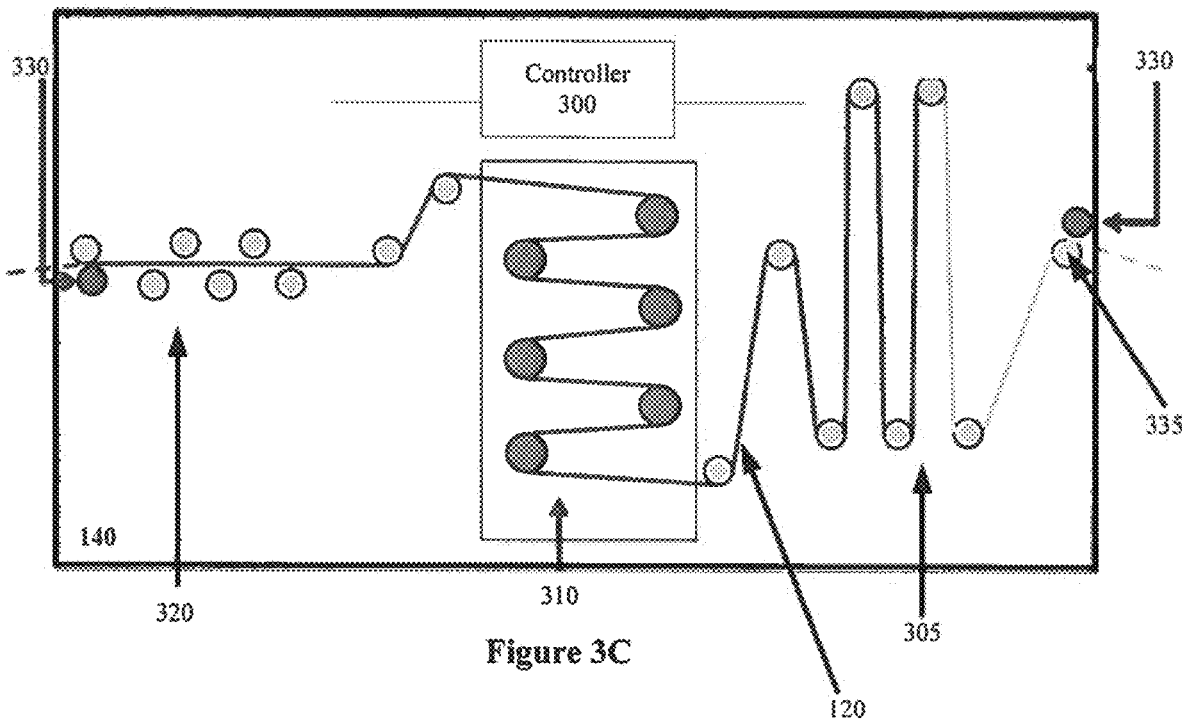

According to one embodiment, system 140 includes a dual dancer roller system coupled with the dryer to prevent the sections of web 120 from staying wrapped around a dryer roller until the rollers have a chance to cool off. In a further embodiment, web 120 may be moved backward and forward (back and forth) even after printing system 100 has stopped printing to further prevent the sections from staying wrapped around a dryer roller. FIGS. 3A-3C illustrate embodiments of a curl resistant system 140.

As shown in FIGS. 3A-3C, system 140 includes a input dancer rollers 305 and output dancer rollers 320 on either side of a stationary drying rollers 310. During printing, dryer rollers transport web 120 through system 140 in a forward direction from the input to the output. However when printing stops, rollers 305 move web 120 back and forth over to prevent a section of web 120 from being exposed to isolated heat and wrap angle, which could cause permanent curling of web 120 over dryer rollers 310. System 140 also includes a controller 300 to control various drying operations.

FIG. 3A illustrates one embodiment of system 140 during printing. As shown in FIG. 3A, web 120 is received at system 140 by travelling between a pinch roller 330 and a deflection roller 335, which provide stability as the web enters system 140. Pinch roller 330 may be in a fixed position or driven towards (or away from) deflection roller 335 by a positioning mechanism depending on the web handling needs. Deflection roller 335 may be either rotationally free spinning, braked or motor driven depending on the web handling needs. Ink applied to web 120 has dried to some extent prior to arriving at system 140.

In one embodiment, pinch roller 330 and deflection roller 335 enable web 120 to move during printing. Subsequently, web 120 passes through input dancer rollers 305 in a forward direction before being passed to drying rollers 310 by additional deflection rollers 335. In such an embodiment, dancer rollers 305 have minimal or no contact with web 120 during printing. Web 120 is received at dancer rollers 320 via deflection rollers after passing through drying rollers 310. In this embodiment, dancer rollers 320 are in a contact position with web 120 to provide tensioning and/or buffering for the web 120. An additional benefit is cooling of the web through contact with the dancing rollers or through airflow.

FIG. 3B illustrates one embodiment of system 140 once printing has stopped. Once printing is stopped, pinch rollers 330 and deflection roller 335 at the input and output of system 140 are engaged to prevent portions of web 120 external to system 140 from moving. Further, dancer rollers 305 engage, and pull, web 120 in a reverse direction from the output side through dryer rollers 310 to the input side. Upon web 120 being pulled into the input side, dancer rollers 320 retract to enable such movement. According to one embodiment, controller 300 provides a signal to pinch rollers 330 and dancer rollers 305 to initiate the above-described actions upon detecting that printing has stopped. However in other embodiments, controller 300 may pneumatically, or electromechanically control rollers 330, rollers 335 and rollers 305.

FIG. 3C illustrates one embodiment of system 140 once printing has stopped and dancer rollers 305 have been fully engaged. As shown in FIG. 3C, dancer rollers 305 are fully expanded to absorb all of web 120 from the output side, and dancer rollers 320 have minimal or no contact with web 120. In one embodiment, controller 300 may control movement of each of dancer rollers 305 and/or 320 independently, as discussed in more detail below, to enable web 120 in a forward and backward direction while printing has stopped. The above-described embodiment prevents a given section of web 120 from being exposed to isolated heat and wrap angle since rollers 305 had minimal or no previous contact with web 120 prior to printing being stopped.

As discussed above, other embodiments may feature system 140 as an independent web handling device. In such an embodiment, the above-described function of output dancer rollers 320 may be solely implemented (e.g., no input dancer rollers or drying rollers).

Figure 4A:
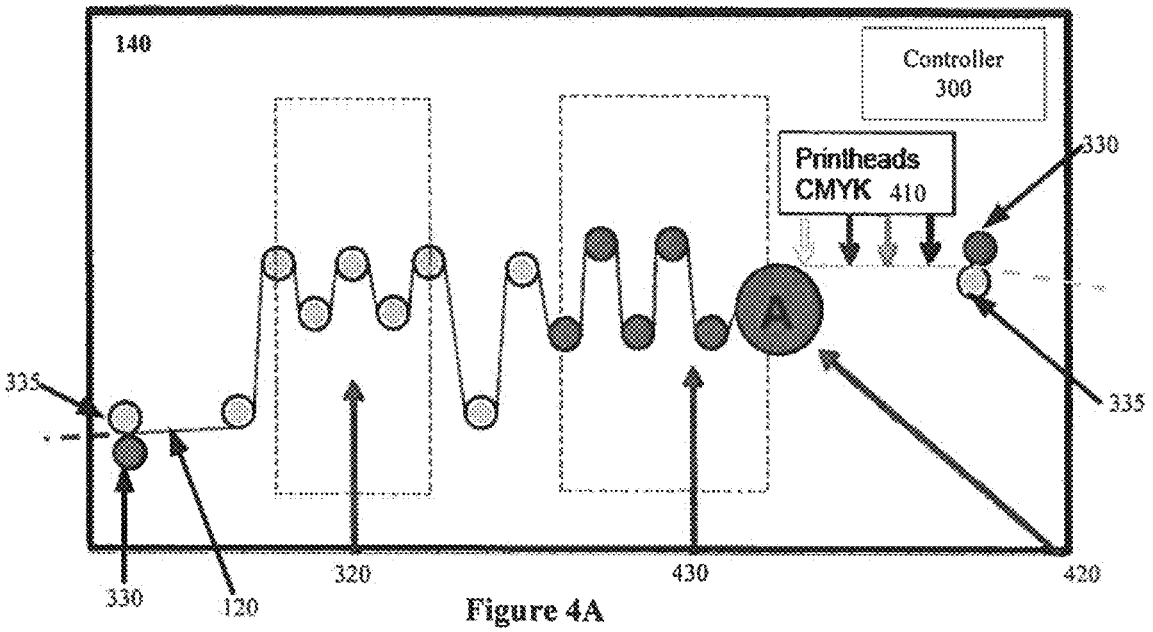
FIGS. 4A and 4B illustrate additional embodiments of a curl resistant dryer.
Figure 4B:
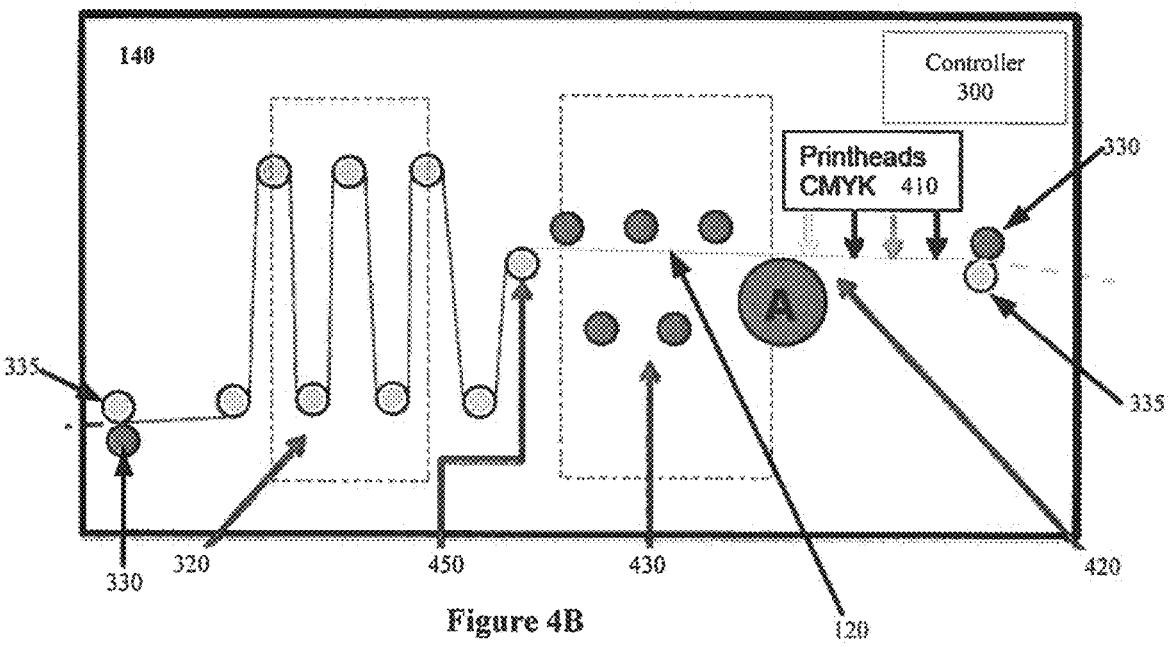

FIGS. 4A and 4B illustrate another embodiment of a curl resistant system 140. In this embodiment, dryer rollers include a large diameter roller 420 and dryer rollers 430. In one embodiment, roller 420 is a stationary initial dryer roller to cure ink on a printed side of web 120 prior to the printed surface touching dryer rollers 430. Dryer rollers 430 are movable to automatically engage web 120 during printing and automatically disengage from web 120 when printing stops.

FIG. 4A illustrates one embodiment of system 140 in which dryer rollers 430 are in the engaged position during printing. Additionally, output side dancer rollers 320 have minimal or no engagement with web 120 during printing. However in other embodiments, rollers 320 may be engaged during printing to provide cooling, and later expand further to pick up web 120 from dryer rollers 430 upon disengagement.

FIG. 4B illustrates one embodiment of system 140 in which dryer rollers 430 are disengaged when printing has stopped. In this embodiment, dryer rollers 430 are moved to the disengaged position such that web 120 does not touch the stationary dryer roller 420 due to a deflection roller 450 being slightly higher in elevation. Also, dancer rollers 320 are positioned further apart to pick up slack attributed to the disengaging of dryer rollers 430. As alluded to above, dancer rollers 320 may be chilled to compensate for heat accumulated during the printing process in order to prevent paper curl/browning of web 120.

Figure 5A:
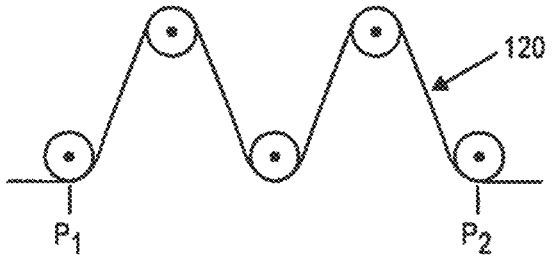
FIGS. 5A-5D illustrate embodiments of independent dancer rollers.

According to one embodiment, dancer rollers 320, and dancer rollers 305 in FIG. 3, may move independently for such prevention. FIGS. 5A-5D illustrate embodiments of independent dancing rollers. FIG. 5A represents an initial position of dancer rollers 320 during printing (or running mode operation). In the running mode operation, web 120 is traversing between points P1 and P2 in a web buffer (e.g., dancer accumulator or festoon accumulator). The web buffer facilitates web 120 movement between two web processing devices that may have different speeds, accelerations or pausing characteristics.

In this mode, dancer rollers 320 move position to maintain set web tension and also buffer a length of web. The amount of buffered web length (between P1 and P2) is increased or decreased as needed in order to maintain the set web tension. In the basic case, a force (e.g., weight gravity, spring, pivot, pneumatic cylinder or other mechanism) is applied to the biased dancer rollers that results in tensioning the web. If the output of the buffer is consuming web faster than is input to the buffer, biased dancer rollers 320 will rise (e.g., in a direction opposite to the force on the biased dancer rollers).

If the output of the buffer is consuming web slower than is the input to the buffer, the biased dancer rollers will fall (e.g., in the direction of the force on the biased dancer rollers). If the biased rollers maintain their midpoint position, then the output and input web speeds of the buffer are equal. Typically, the biased rollers are fixed together and therefore move together, while the non-biased rollers are held in fixed position. In some embodiments, the force on the bias rollers in controlled by controller 300 for advanced dynamic control.

When printing stops (or reduced curl mode operation), web 120 has stopped traversing points P1 to P2 (e.g., the web has been stopped to change the paper web supply roll or because of some system error). In this mode, the objective is to maintain constant web tension (so that web 120 stays aligned on rollers 320 and does not wrinkle), constant buffered web length between P1 and P2 (so that upstream or downstream web processing devices are not impacted) and not allow dancer rollers 320 to stay in the same roller-to-web contact locations for very long periods. This reduces web curl versus an alternative of maintaining the same roller-to-web contact locations. This mode is especially helpful for reducing curl when the dancer rollers are hot which would otherwise increase web curling.

Figure 5B:
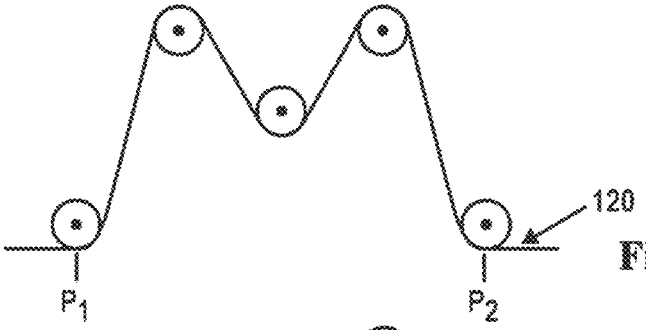
Figure 5C:
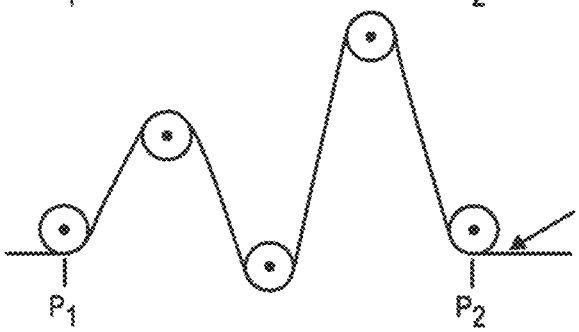
Figure 5D:
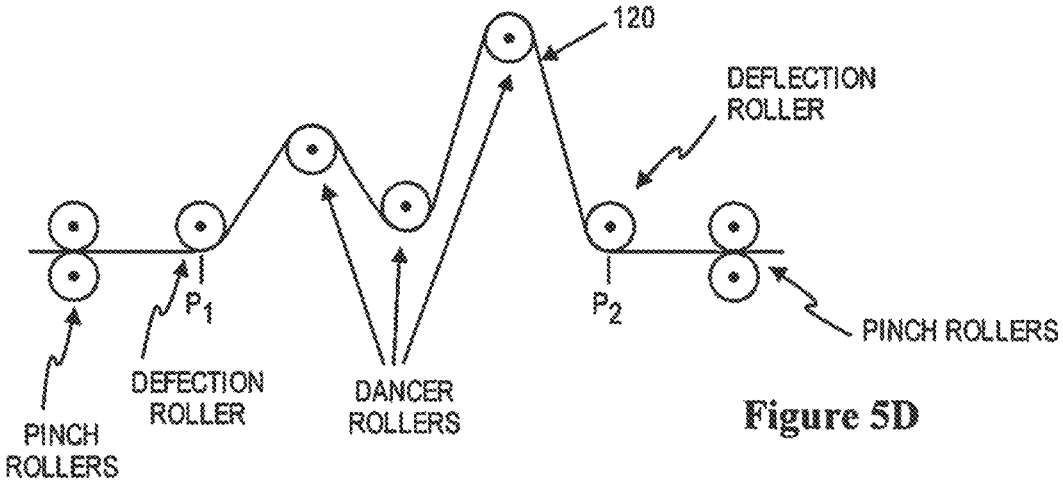

At some time point controller 300 detects the start of the reduced curl mode (either from web sensor motion detection or by some other signal received by controller 300). Subsequently, controller 300 moves some dancer rollers 320 to different vertical positions such that the buffered web length is maintained and the desired web tension is maintained, which results in the web not traversing (as viewed from points P1 and P2). However, the roller-to-web contact locations are changing as the rollers move positions. In that sense, the buffered web is not traversing (in relation to P1 and P2) but the rollers are traversing the buffered web (in relation to P1 and P2). FIGS. 5B-5D illustrate various embodiments of dancer roller re-positioned dancer rollers 320.

In moving roller positions, the buffered web length and tension are maintained during the entire coordinated movement of the roller positions. In one embodiment, actively controlled roller positioning is implemented electromechanically via controller 300. In such an embodiment, controller 300 commands new roller positions. In a further embodiment, input from roller position sensors, web tension sensors and other sensors can provide feedback for controller 300, which may implement PID feedback control to command the system. In another embodiment, no rollers are biased with a force and all roller position movements are driven by the controller using sensor feedback.

In one embodiment, the roller positions are moved vertically up and down resulting in the web moving forward and backward (back and forth) in relation to the rollers. In a further embodiment, roller positions may be continuously changed or incrementally changed at set time intervals. Further, not all rollers need to move positions in order for the roller-to-web locations to change. However, a preferred embodiment includes non-biased rollers as the two end rollers and moving the position of at least those two rollers. Further, the roller position may be restricted so as to not be moved beyond the web plane of adjacent rollers in order to properly maintain web tension (otherwise the web becomes un-engaged from one or more rollers).

According to one embodiment, controller 300 may store initial roller positions at the start of the reduced curl mode and return the position driven rollers to the initial positions when the reduced curl mode is ending. Controller 300 is notified of the end of the reduced curl mode by detecting web movement outside of buffered web length. However in other embodiments, controller 300 may or receive an external signal, which results in controller 300 changing to the running mode (or some other mode).

In one embodiment, controller stops the roller position movement if a machine cover or guard sensors detect operator entry into the roller area in order to insure operator safety. Furthermore, the system 140 doors can be locked to prevent the operator from opening the doors until the dryer rollers have cooled down to an acceptable temperature for the web to be stationary over the dryer rollers.

Figure 6A:
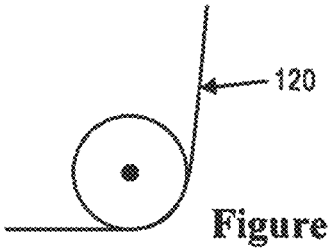
FIGS. 6A-6D illustrate embodiments of deflection rollers.
Figure 6B:
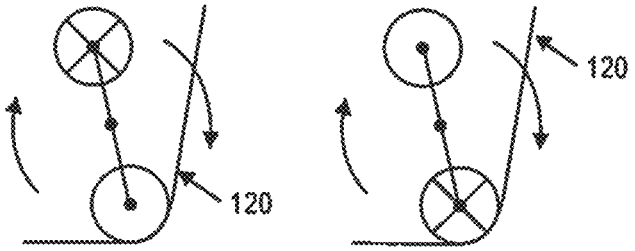
Figure 6C:
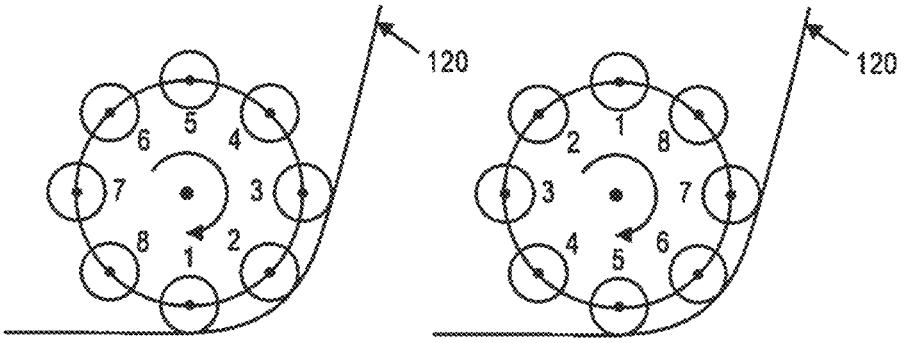
Figure 6D:
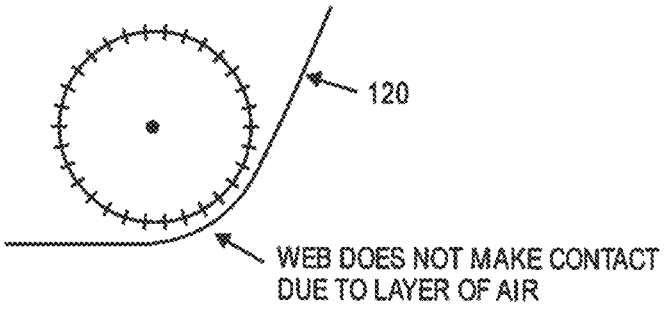

Since deflection rollers 335 maintain contact with web 120, various types of deflection roller configurations may be implemented to minimize possible curl from elevated temperature deflection rollers. FIGS. 6A-6D illustrate embodiments of deflection rollers. FIG. 6A illustrates a non-changeable deflection roller 335 similar to those shown in FIGS. 3 and 4. FIG. 6B illustrates one embodiment of a pivot arm deflection roller 335 that rotates the arm upon changing from the running mode to the reduced curl mode. In this embodiment, the multiple rollers attached to the arms of roller 335 may then be selectively placed in contact with the web. FIG. 6C illustrates one embodiment of a planetary roller wheel 335 that also rotates upon changing from the running mode to the reduced curl mode. In this embodiment, the multiple rollers attached to the circumference of 335 may then be selectively placed in contact with the web. FIG. 6D illustrates one embodiment of an air bearing roller 335 in which web 120 does not make with the roller 335 due to a layer of air in between that is forced out of passages of 335. Dancer rollers 320, dancer rollers 305 and pinch rollers 330 may also use these deflection roller configurations.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. A web handling system comprising:

first dancer rollers configured to enable a web of a print medium to move in a downstream direction towards an output of the system and move a section of the web downstream of the first dancer rollers in an upstream direction towards an input of the system;

drying rollers to convey the web in the downstream direction during a printing operation;

second dancer rollers to convey the web in the downstream direction during the printing operation;

a controller to transmit one or more signals to the first dancer rollers to provide an indication of a printing operation, wherein the one or more signals include a first signal that causes the first dancer rollers to enable the web to move in the downstream direction as an indication of the printing operation, and a second signal that causes the first dancer rollers to move the section of the web in the upstream direction as an indication of stopping of the printing operation.

2. The system of claim 1 further comprising:

a first pinch roller at an input of the system; and a second pinch roller at an output of the system, wherein the controller transmits a third signal to the first and second pinch rollers to cause the first and second pinch rollers to be engaged with the web to prevent the web from moving through the input and the output.

3. A web handling system comprising:

first dancer rollers configured to enable a web of a print medium to move in a downstream direction towards an output of the system and move a section of the web downstream of the first dancer rollers in an upstream direction towards an input of the system, wherein the first dancer rollers move the web by pulling the web in the upstream direction upon stopping of the printing operation; and a controller to transmit one or more signals to the first dancer rollers to provide an indication of a printing operation, wherein the one or more signals include a first signal that causes the first dancer rollers to enable the web to move in the downstream direction as an indication of the printing operation, and a second signal that causes the first dancer rollers to move the section of the web in the upstream direction as an indication of stopping of the printing operation.

4. The system of claim 3 wherein the second dancer rollers retract to have minimal contact with the web to allow the web to move in the upstream direction.

5. The system of claim 1 wherein the drying rollers are positioned downstream of the first dancer rollers and upstream of the second dancer rollers.

6. The system of claim 3 wherein the first dancer rollers expand positions to pull the web.

7. The system of claim 4 wherein the controller transmits a fourth signal to the second dancer rollers to cause the second dancer rollers to retract.

* * * * *